United States Patent [19]

Pitts

[11] Patent Number: 4,629,349

[45] Date of Patent: Dec. 16, 1986

[54] FLEXIBLE TRANSPARENT NOTEBOOK AND THE LIKE

[75] Inventor: Warren R. Pitts, Needham, Mass.

[73] Assignee: Dennison Manufacturing Company, Framingham, Mass.

[21] Appl. No.: 629,918

[22] Filed: Jul. 11, 1984

[51] Int. Cl.[4] ..... B42F 3/00; B42D 3/00

[52] U.S. Cl. ..... 402/74; 281/31

[58] Field of Search ..... 402/70, 71, 72, 73, 402/74, 76; 281/31; 493/220

[56] References Cited

U.S. PATENT DOCUMENTS

| | | | |
|---|---|---|---|
| 1,023,834 | 4/1912 | Gareis | 281/31 |
| 1,565,255 | 12/1925 | Byquist | 281/31 |
| 2,382,476 | 8/1945 | Glasoe, Jr. | 281/31 |
| 2,390,958 | 12/1945 | Perlin | 281/31 |
| 2,477,840 | 8/1949 | Vasilas | 281/31 |
| 2,828,975 | 4/1958 | Wright | 281/31 |
| 2,926,932 | 3/1960 | Koerder | 281/31 |
| 3,092,400 | 6/1963 | Smith | 281/31 |
| 3,161,216 | 12/1964 | Sloves | 281/31 |
| 3,680,969 | 8/1972 | Gorman | 281/31 |
| 3,845,696 | 11/1974 | Long et al. | 493/220 |
| 3,870,223 | 3/1975 | Wyant | 281/31 |
| 4,420,112 | 12/1983 | Cline | 281/31 |

FOREIGN PATENT DOCUMENTS

| | | | |
|---|---|---|---|
| 332119 | 4/1930 | United Kingdom | 281/31 |

*Primary Examiner*—Paul A. Bell
*Assistant Examiner*—Paul M. Heyrana, Sr.
*Attorney, Agent, or Firm*—George E. Kersey

[57] ABSTRACT

Looseleaf notebooks, report folders, and similar stationary items incorporating a deep pocket extending over the length of the item. A flexible transparent notebook of this design incorporates a pair of thermoplastic sheets which are cut to the appropriate dimensions and heat-sealed to form a pocket which is coextensive with the outer notebook cover. A ring binder support is fastened to the center of one of the plastic sheets. Such notebooks, report folders, or the like may advantageously incorporate an auxiliary pocket affixed at one of the outer edges to permit folding along this edge. The notebook may be provided with an opaque cover by inserting one or more opaque sheets within the large outer pocket.

21 Claims, 5 Drawing Figures

FLEXIBLE TRANSPARENT NOTEBOOK AND THE LIKE

BACKGROUND OF THE INVENTION

The present invention relates to stationery pockets such as notebook report folders and the like.

An extremely popular class of products for educational and business uses include notebooks, report covers, and similar items for retaining papers, fabricated from inexpensive thermoplastic or thermoset materials. The most widely available versions of these are characteristically simple in design, including perhaps one or two pockets for retaining papers; or in the case of notebooks, relying on a ring binder mechanism for this purpose. Although such commonly available designs have the virtue of simplicity, they encounter various disadvantages in use. For example, it is often desirable to remove selected pages from a notebook and temporarily store these in a separate compartment or location. Although looseleaf notebooks or folders may include pockets for this purpose, these are typically limited in capacity and permit retention of only a few sheets, and will not permit storage of bulkier items. In addition, the common expedient of locating such pockets at the front or back cover poses practical difficulty that items stored therein may interface with recording onto sheets contained within the notebook.

Accordingly, it is a principal object of the invention to provide improved designs for looseleaf notebooks, report folders, and like stationery items for retaining a plurality of pages. Such design should provide flexibility in temporarily storing sheets at convenient locations.

Another object is to achieve aesthetically pleasing designs in such stationery products. A specific objective is to provide transparent notebooks and the like, in combination with means for superimposing an opaque structure.

A further objective is to provide facilities for storing papers as well as bulkier items in a manner which will not interfere with inscription of sheets contained within a looseleaf notebook or the like.

Still another object is to achieve a multipurpose characteristic in such stationery products, whereby they may be utilized for convenient storage for loose sheets of paper and bulkier items, as well as for their primary binding purposes.

SUMMARY OF THE INVENTION

In furthering the above and additional objects, the invention provides novel designs for looseleaf notebooks, report folders, and similar stationery binders which are characterized by the presence of a large pocket which is coextensive with the covers of such binders. In the preferred embodiment, means are provided for temporarily securing the open edge of such pockets, while permitting access to the pocket's interior when desired.

One aspect of the invention relates to the typical manufacture of such binders. In the preferred embodiment, a flexible transparent notebook or the like is fabricated of a transparent thermoplastic or thermoset material. Two sheets of this transparent material are laminated together along the outer edges and bottom of the notebook, thereby defining an open pocket which is accessible along the top edge and is coextensive with the cover. Most preferably, one or more flaps are provided at the open edge of the pocket to permit closure.

Typically, fastening means associated with these flaps permit the user to secure closure.

Another aspect of the invention relates to a transparent appearance of these notebooks, report covers, etc. in combination with optional supplementary opaque inserts. Typically, such inserts take the form of one or more opaque sheets having dimensions somewhat smaller than the interior boundaries of the pocket. Such inserts may take the form of a single sheet which occupies essentially the entire pocket or a pair of sheets respectively coextensive with the front and rear covers.

In a preferred embodiment of the invention, an auxilliary pocket assembly is appended to one of the outer edges of the notebook or report cover. Such auxilliary pocket is advantageously coplanar with the adjacent cover and is joined to the cover's outer edge to permit folding within the notebook. This pocket may be conveniently fabricated of the same material as the cover and during manufacture cut to define the desired pocket dimensions. Either the main or the auxiliary pocket may have pleated edges to provide an accordion-like structure, permitting expansion of the pocket.

BRIEF DESCRIPTION OF THE DRAWINGS

The above and additional objects of the invention are illustrated in the detailed description of the preferred embodiments, which follows, advantageously to be taken in conjunction with the drawings in which.

DETAILED DESCRIPTION

Figure 1:
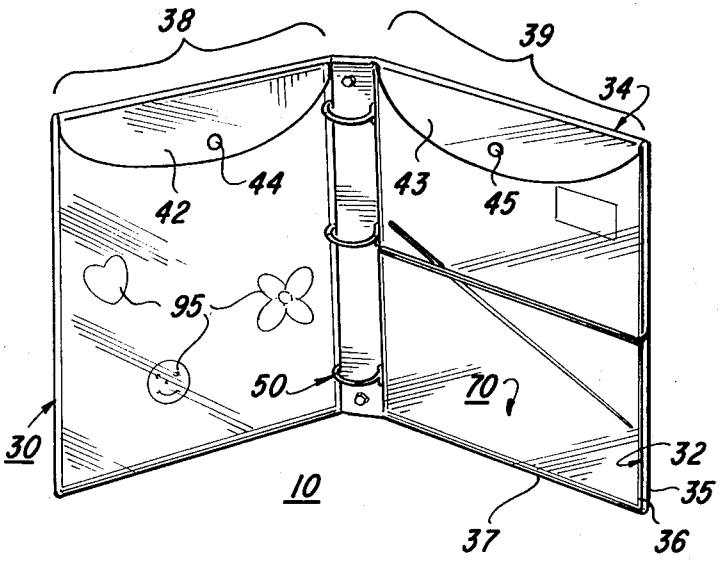
FIG. 1 is a perspective view of a looseleaf notebook in accordance with the preferred embodiment, viewing the interior cover of such notebook.
Figure 4:
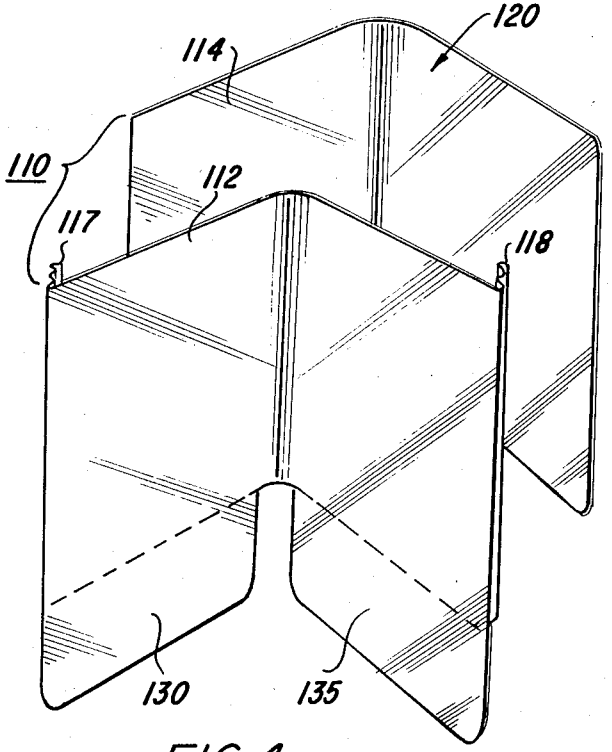
FIG. 4 is an exploded view of the folder of FIG. 3.

Reference should now be had to FIGS. 1–5 for a detailed description of a flexible transparent looseleaf notebook according to a preferred embodiment of the invention. FIG. 1 shows a looseleaf notebook 10, opened to view its inside, in the absence of any sheets retained within the three-ring binder mechanism 50. The notebook cover 30 is fabricated of a transparent thermoplastic or thermoset material, fabricated in the form of two laminated sheets 32, 34 which define an interior pocket 40 coextensive with the cover sheets. The cover 30 is folded in half to provide front and rear covers 38 and 39. Illustratively, the notebook cover 30 takes the form of a pair of vinyl sheets which are heat-sealed together at the outer edges 35, 36, as well as along the bottom edge 37. FIG. 1 shows the open edge 101 (FIG. 2) of pocket 40 (see index finger A of FIG. 5) sealed with flaps 42 and 43 which are integral with the outer cover sheet 34. These flaps are shown folded over and secured to the interior cover 32 by engagement of snap fasteners 44, 45.

Binder assembly 50 includes a ring binder support 51, secured to the interior cover sheet 32 at 52, 53 by plastic or metal fasteners 103. Advantageously, this binder is of the type which incorporates plastic rings 56–58, rather than the more common metal rings which require a more massive and expensive mechanism at the binder's spine to open and close the rings. In the embodiment of FIG. 1, rings 56 and 58 are anchored at one end to the binder support 51 and engage mating apertures (not shown) at their opposite ends. In use, these rings 56–58 may be opened or closed by a simple manipulation thereby permitting access to the sheets contained within notebook 10 from one end.

Figure 2:
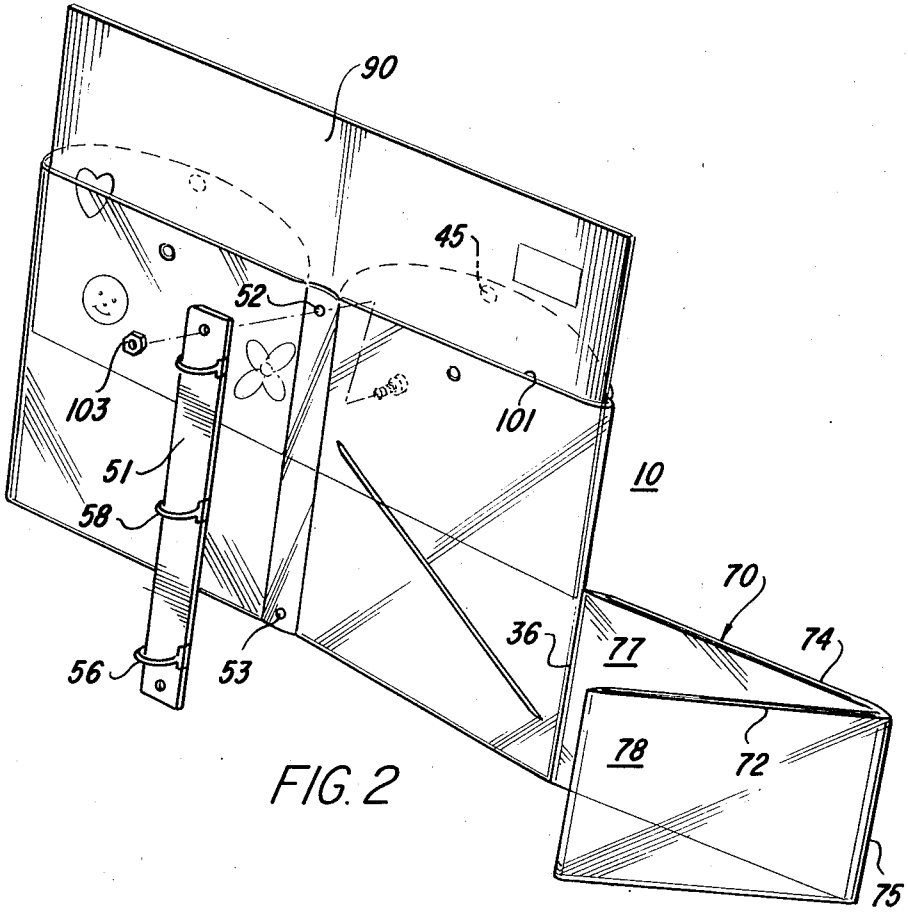
FIG. 2 is a further perspective view of the notebook of FIG. 1, illustrating the opening of the cover pocket and auxilliary pocket.

The notebook 10 of FIGS. 1 and 2 incorporates an auxilliary pocket assembly 70 for retaining papers or bulkier materials, such as pens, pencils, or the like. In the illustrated embodiment, the assembly 70 is formed of two layers 72 and 74 which are folded back at 75 and sealed at the notebook edge 36 to define an interior pocket 76 (see index finger b of FIG. 5) with two sections 77 and 78. Assembly 70 is joined along notebook edge 36 to permit folding against the notebook cover 30 for compact storage (FIG. 1), or unfolding of the pocket as shown in FIG. 2. This permits the user to store bulky materials within such pocket while avoiding interference with recording onto sheets contained within the notebook 10.

Figure 3:
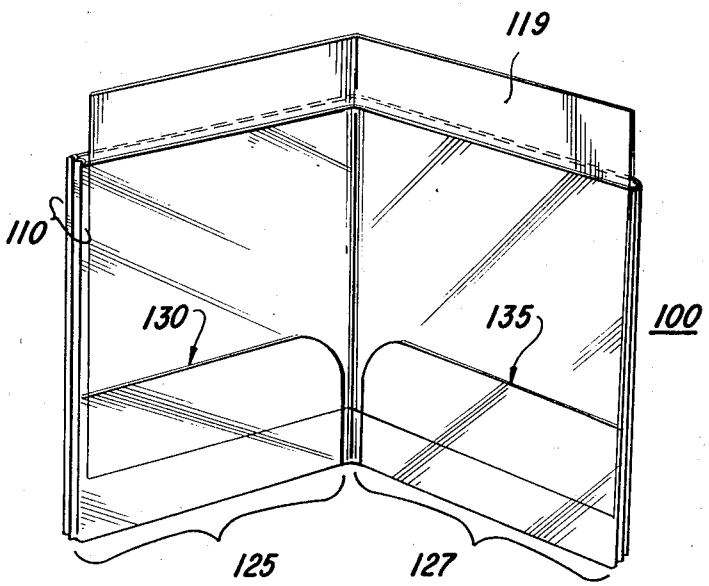
FIG. 3 is a perspective view of a presentation cover folder in accordance with an alternative embodiment of the invention, as seen from its inside.
Figure 5:
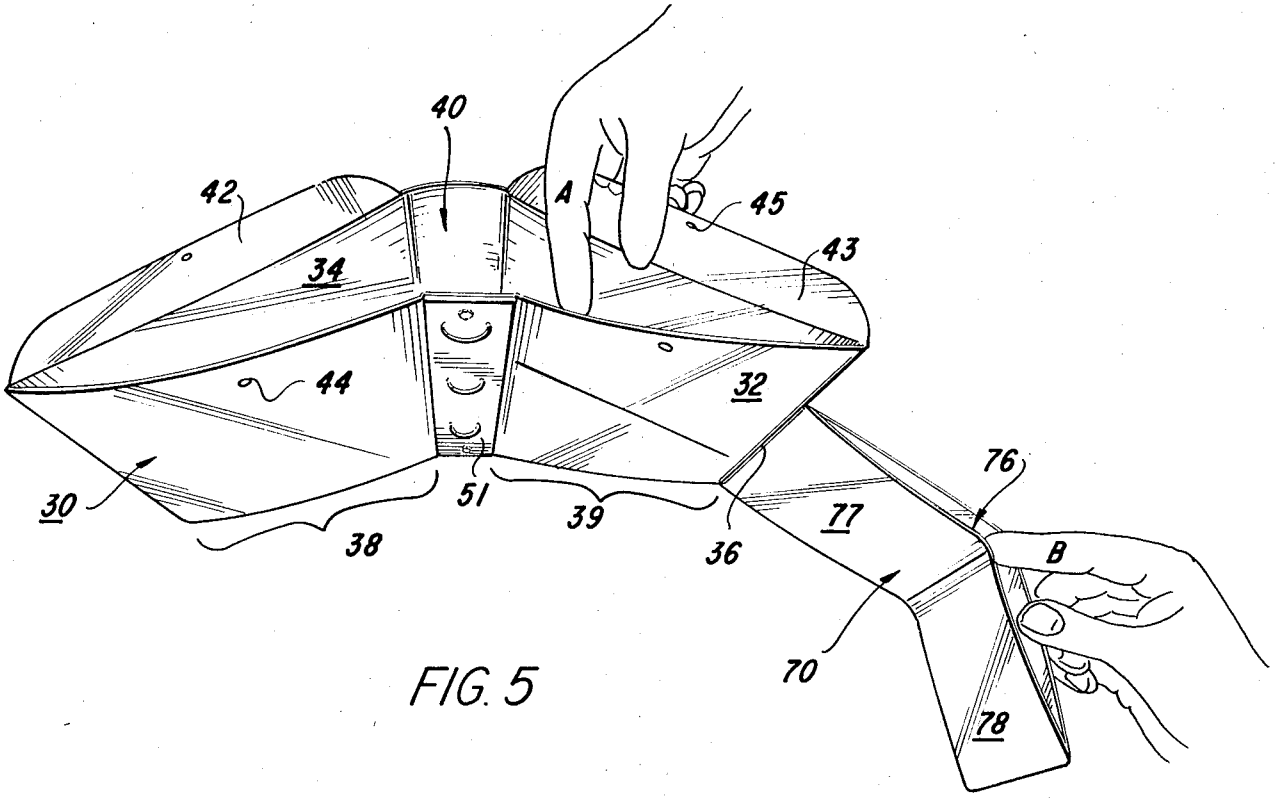
FIG. 5 is a perspective view of the folder of FIG. 1.

With reference to FIG. 3, in order to achieve a desired aesthetic effect in notebook 10, an opaque sheet 90 is inserted within the pocket 40 to occupy essentially the entire pocket—i.e. opaque insert 90 extends continuously across the entire width of folder 10. Alternatively, a pair of opaque sheets (not shown) may be provided and respectively inserted in the front and back covers 38, 39. The opaque insert 90 may take any suitable form, such as colored paper or various plastic materials. This insert 90 may be decorated by the user to provide a unique appearance, as by application of decorative stickers 95.

FIG. 3 depicts a report presentation folder 100 according to an alternative embodiment. The folder cover 110 comprises laminated sheets 112 and 114, forming front and rear covers 125 and 127, which may be configured and fabricated in a manner similar to that discussed above with respect to the notebook cover 30 of FIGS. 1 and 2. In cover folder 100, the two cover sheets 112 and 114 are joined along pleated outer edges 117, 118, thereby providing an accordion-like expandibility of pocket 120. The report cover 100 may be folded to serve its normal function, or alternatively may be unfolded to permit insertion of materials, such as opaque insert 119, into the pocket 120. This provides an alternative, convenient mode of carrying papers within the folder for transportation and storage. This, in effect, converts the folder 100 (or the notebook 10 of FIGS. 1 and 2) into a valise, protecting any papers contained therein from becoming wet or otherwise damaged. The folder 100 also includes interior pockets 130, 135 for storage of papers against the interior surfaces of the front and rear covers 125 and 127.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

I claim:

1. A holder for paper sheets and the like, comprising first interior and second (exterior) noncongruent cover sheets, joined along outer edges and bottom edge to define an interior pocket extending continuouly from outer edge to outer edge with an opening at the upper edge of said holder, said cover sheets being folded to meet at an inner face wherein they provide front and rear covers.

2. The sheet holder of claim 1, wherein the cover sheets are comprised of a material selected from the class consisting of thermoset materials.

3. The sheet holder of claim 2, wherein the exterior cover sheet is transparent.

4. The sheet holder of claim 3, further comprising at least one opaque member inserted within said pocket.

5. The sheet holder of claim 1, further comprising a looseleaf binder mechanism joined to the inner face of said cover at the fold.

6. The sheet holder of claim 1, wherein one of the cover sheets includes at least one flap at its upper edge, said flap being folded over into the other cover sheet to seal the opening.

7. The sheet holder of claim 6, wherein said flap includes a fastener to secure it to the other cover sheet.

8. The sheet holder of claim 1, further comprising an auxiliary pocket member comprising a plurality of sheets defining an interior pocket, wherein said sheets are joined to the outer edge of the rear cover so as to be foldable about themselves and against the inner face of that cover.

9. The sheet holder of claim 1, wherein the cover sheets are joined at pleated edges, providing an expandible pocket.

10. A looseleaf notebook as defined in claim 1, further comprising an auxiliary pocket assembly foldably joined to the rear cover of said notebook at its outer edge, said auxiliary pocket assembly comprising a flat structure defining an interior multiple pocket.

11. A looseleaf notebook as defined in claim 10, wherein the auxiliary pocket assembly is fabricated of like materials as the notebook cover.

12. A looseleaf notebook as defined in claim 10, wherein the auxiliary pocket assembly includes a plurality of folded portions.

13. Folder, comprising:

A first cover sheet;

A second cover sheet joined to said first cover sheet along a common bottom edge and opposing common side edges, defining an interior pocket extending continuously from side edge to side edge;

a first flap cover sheet having side edges shorter than the side edges of said first and second cover sheets; and a second flap cover sheet having side edges shorter than the side edges of said first and second cover sheets, joined to said first flap cover sheet along a common bottom edge and along opposing common flap side edges, defining an interior flap pocket extending continuously from flap side edge to flap side edge, one joined common flap side edge fastened to one joined common side edge of said first and second cover sheets;

wherein said interior pocket is folded vertically along a line between said side edges, and said flap interior pocket is folded vertically along a line between said flap side edges.

14. Folder of claim 13, wherein said folded flap interior pocket is folded along the joining side edge to lie within the interior pocket when same is folded.

15. Folder of claim 13, wherein said cover sheets and flap cover sheets are of thermoplastic material, and are joined by heat sealing.

16. Folder of claim 13, further comprising:

means for holding papers, connected to said second cover sheet, disposed along the vertical fold line.

17. Folder, comprising:

A first cover sheet having pleated side edges;

A second cover sheet joined to said first cover sheet along said pleated side edges; and A flap extending from the bottom edge of said second cover sheet, divided along a vertical line disposed between said side edges to form two flap portions;

wherein said flap portions are folded upwards forming pockets between said flap portions and said second cover sheet, and said cover sheets are joined along their respective common bottom edges forming an interior pocket extending continuously from side edge to side edge;

wherein said combined first and second cover sheets are folded along a vertical line disposed between said side edges, forming front and rear folder covers having interior pockets defined by said flap portions.

18. Folder of claim 17, wherein said cover sheets are of thermoplastic material and are joined by heat sealing.

19. Folder of claim 17, further comprising:

means for holding papers, connected to said second cover sheet, disposed along the vertical fold line.

20. A holder comprising:

an interior cover sheet;

an exterior cover sheet joined to said interior cover sheet to form a cover member with a storage pocket therein;

one of the cover sheets having a side which extends beyond the corresponding side of the other cover sheet;

said cover member being foldable about an axis in the face of the interior cover sheet for the storage of contents between the folds of said interior cover sheet; and the extended side of said one of the cover sheets being foldable at least in part relative to said interior cover sheet;

whereby the extended and folded side of said cover sheet seals that portion of said storage pocket between the folded interior cover sheet and the folded exterior cover sheet or forms an additional storage pocket.

21. The method of storing items which comprises the steps of:

(a) joining an exterior cover sheet to an interior cover sheet to provide a cover member with a storage pocket for items between said interior and exterior cover sheets, one of the cover sheets having a side that extends beyond the corresponding side of the other cover sheet;

(b) folding said cover member along an axis in the face of said interior cover sheet to permit the storage of items between the folds of said interior cover sheet; and (c) folding at least a part of the extended cover sheet with respect to the interior cover sheet to permit the sealing of items in that part of said storage compartment between said interior and exterior cover sheets or provide an additional storage pocket.

* * * * *